US007886465B2

(12) United States Patent
Virvo

(10) Patent No.: US 7,886,465 B2
(45) Date of Patent: Feb. 15, 2011

(54) PRESENTATION DISPLAY

(76) Inventor: Alexander Virvo, 33 Glen Ter., Stamford, CT (US) 06906

( * ) Notice: Subject to any disclaimer, the term of this patent is extended or adjusted under 35 U.S.C. 154(b) by 1262 days.

(21) Appl. No.: 10/749,070

(22) Filed: Dec. 30, 2003

(65) Prior Publication Data

US 2004/0148833 A1 Aug. 5, 2004

Related U.S. Application Data

(60) Provisional application No. 60/437,654, filed on Jan. 3, 2003.

(51) Int. Cl.
*A47G 29/00* (2006.01)

(52) U.S. Cl. ..... 40/539; 211/72

(58) Field of Classification Search ..... 40/605, 40/610, 124.09, 124.12, 539; 160/135; 434/429, 434/430; 312/258, 259, 262; 211/72, 70.1; 206/745, 747, 748
See application file for complete search history.

(56) References Cited

U.S. PATENT DOCUMENTS 1,262,209 A * 4/1918 King ..... 126/275 R
1,356,588 A * 10/1920 Bacher ..... 206/561
1,486,695 A * 3/1924 Singer et. al. ..... 206/748
1,852,471 A * 4/1932 Nelson ..... 108/60
2,845,758 A * 8/1958 Lowthian ..... 53/397
3,601,916 A * 8/1971 Epstein ..... 40/605
3,766,675 A * 10/1973 Leigh ..... 40/605
3,980,221 A * 9/1976 Okada ..... 206/586
4,372,086 A * 2/1983 Hanlon ..... 160/135
5,323,836 A * 6/1994 Tuttle et al. ..... 160/135
5,332,085 A * 7/1994 Fraser ..... 206/779
5,806,676 A * 9/1998 Wasgien ..... 206/341
5,934,549 A * 8/1999 Baumgartner et al. .... 229/103.2
6,070,719 A * 6/2000 Pollock ..... 206/232
6,382,433 B1 * 5/2002 Podergois ..... 211/195
6,692,092 B1 * 2/2004 Evans ..... 312/311
7,252,200 B1 * 8/2007 Hester ..... 211/72

* cited by examiner

*Primary Examiner*—Cassandra Davis
(74) *Attorney, Agent, or Firm*—Hoffman Warnick LLC

(57) ABSTRACT

A presentation display for use in a science fair, school project or the like comprises a center panel, a left tray, and a right tray wherein the left tray is attached to the center panel with a flexible hinge and the right tray is attached to the center panel with a flexible hinge. The presentation display is made from a single piece of corrugated cardboard. Multiple presentation displays may be stacked.

13 Claims, 5 Drawing Sheets

PRESENTATION DISPLAY

RELATED APPLICATIONS

This application claims the benefit of the filing date of U.S. Provisional Application No. 60/437,654 for "Universal Free Standing Folding Container Utility for the Creation of Portable Structures Having an Open, Closed and Compactly Folded Position," filed on Jan. 3, 2003 in the name of Alexander Virvo, and which is incorporated herein by reference.

BACKGROUND OF THE INVENTION

1. Field of the Invention

A portable display device for displaying educational material or student's work.

2. Description of the Prior Art

Primary and secondary schools conduct various science fairs, school projects and the like. Typically, a student participating in a science fair might use a freestanding display to present the results of their work. Wood (U.S. Pat. No. 5,911,522) discloses a free standing display for use in this application. The display comprises two side panels and a center panel. Each side panel is joined to a center panel by a hinge. The display device can stand upright only if the two side panels are inclined at an angle relative to the center panel. The side panels do not provide any depth for displaying or storing three dimensional objects.

Davis (U.S. Pat. No. 611,063), Singer et. al. (U.S. Pat. No. 1,486,695), Levkoff (U.S. Pat. No. 1,988,280), Virvo '439 (U.S. Pat. No. 6,220,439 B1) and Virvo '164 (U.S. Pat. No. 6,491,164 B1) each disclose dual containers separated by a center panel. All of these containers require glue or some other separate joining means for assembly.

Tulkoff (U.S. Pat. No. 6,386,440), FIG. 7, discloses a pizza box which uses a locking tab and locking slot to form a portion of a tray.

SUMMARY OF THE INVENTION

A presentation display comprising a center panel, a left tray, and a right tray wherein the left tray is attached to the center panel with a flexible hinge and the right tray is attached to the center panel with a flexible hinge.

BRIEF DESCRIPTION OF DRAWINGS

FIG. 7A illustrates how to insert closure tabs into the right tray.

FIG. 7B illustrates how to secure the left tray and the right tray into a closed position using the closure tabs.

FIG. 7C illustrates how to secure a shelf to the left tray or the right tray.

DETAILED DESCRIPTION OF THE INVENTION

Figure 1:
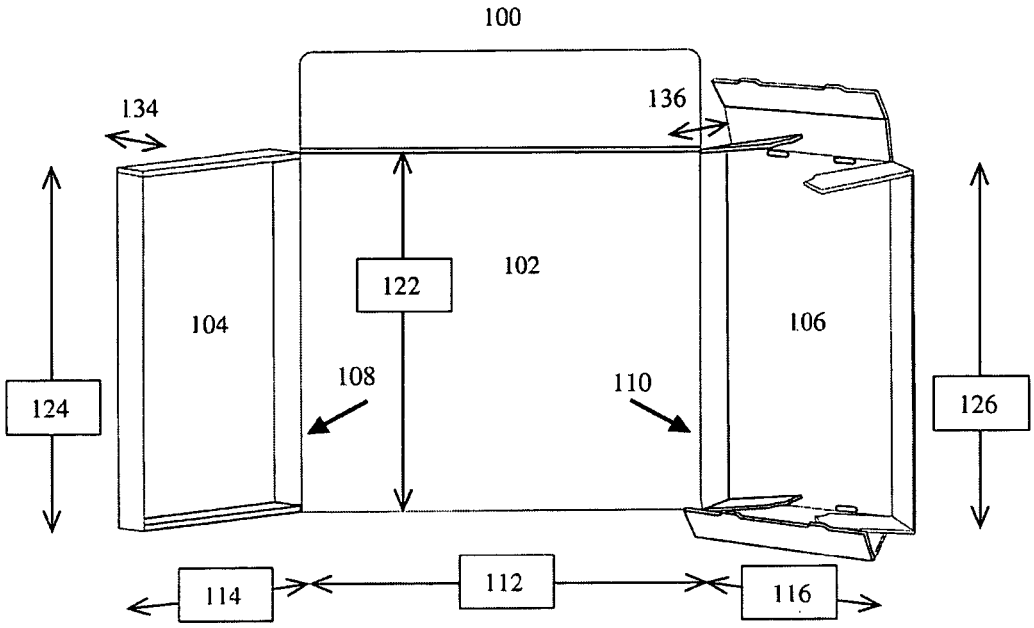
FIG. 1 is a front view of an embodiment of the present invention.

Referring to the drawings and, in particular, to FIG. 1 thereof, the "presentation display" of the present invention is provided and is referred to generally by reference numeral 100. The presentation display generally comprises center panel 102, left tray 104 and right tray 106. The left tray is attached to the center panel by flexible hinge 108. The right tray is attached to the center panel by flexible hinge 110.

The center panel is characterized by width 112 and height 122. The left tray is characterized by width 114, height 124, and depth 134. The right tray is characterized by width 116, height 126 and depth 136.

The right tray in FIG. 1 is shown in a partially assembled state.

Figure 2:
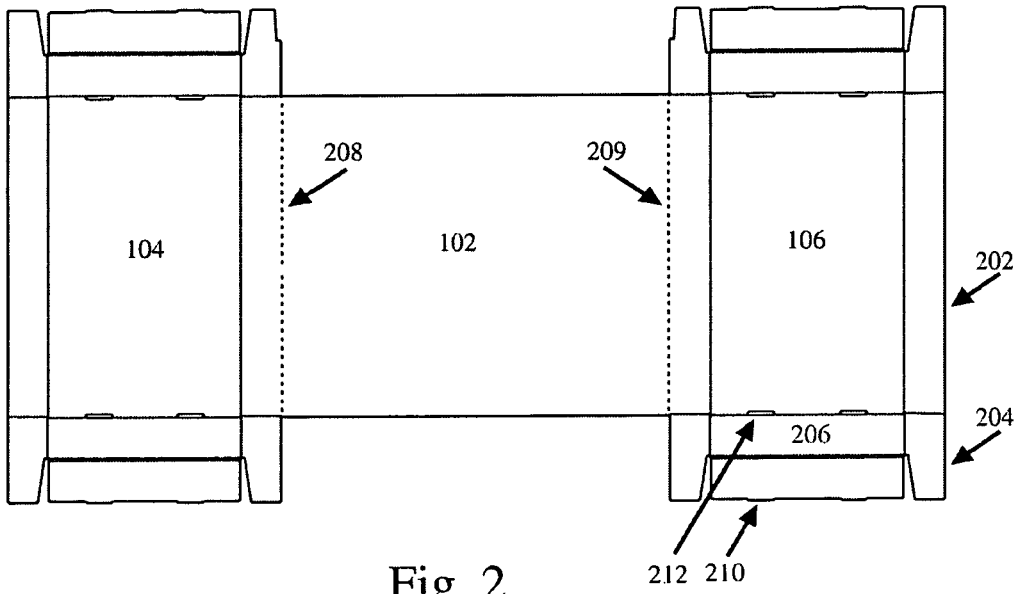
FIG. 2 is a blank for the embodiment of FIG. 1.

FIG. 2 shows the blank for the preferred embodiment of the presentation display 100. In this embodiment, the blank is stamped from a single piece of corrugated cardboard, preferably between ⅛ inch and 1/16 inch in thickness. It should be appreciated, however, that other dimensions and other materials may be used for the blank, including corrugated plastic, foam core, chip board, or any other material that can provide the requisite stiffness for the current application.

Left and right trays 104, 106 each comprise vertical sidewalls 202 terminating in end tabs 204 on either side, and horizontal sidewalls 206 disposed at the top and bottom thereof, said sidewalls 206 having a fold or a score line therein to allow the sidewalls to be folded over on themselves, and terminating in locking tabs 210 provided on the side opposite from the side on which the horizontal sidewalls 206 are hingedly attached to the center panels of the left and right trays 104, 106. Locking slots 212 are provided between the sidewalls 206 and the center panels of the left and right trays 104, 106, said locking slots 212 corresponding to said locking tabs 210.

To assemble presentation display 100, vertical sidewalls 202 are folded up and end tabs 204 are folded in. Horizontal sidewalls 206 are then folded up and over the end tabs 204 such that locking tabs 210 are pushed into locking slots 212. Left and right trays 104, 106 are thus formed. Score lines 208 and 209 are folded to create hinges 108 and 110.

In the preferred embodiment, the width of the left and right trays 104, 106 of presentation display 100 are about equal, although certain applications of the present invention may call for a gap between the left and right trays 104, 106, or an overlap therebetween, and/or different widths for both trays 104, 106. The combined width of both trays is about equal to or less than the width of the center panel such that the trays may be folded against the center panel for easy transport and storage.

Presentation display 100 does not require any glue or other separate fasteners to maintain it's assembled shape.

Figure 3:
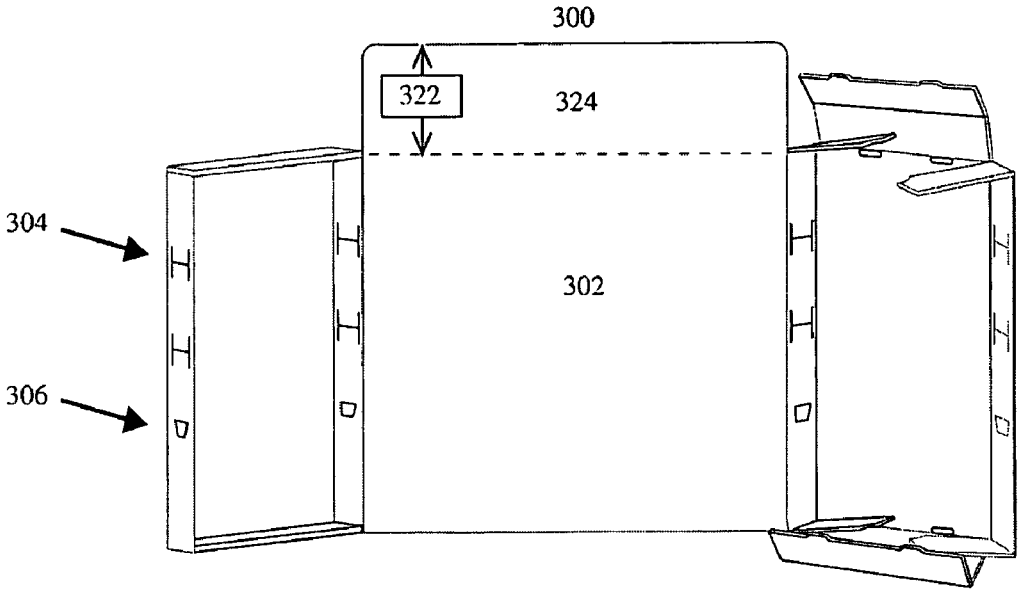
FIG. 3 is a is a front view of an alternative embodiment of the present invention showing additional features relative to the embodiment of FIG. 1.

FIG. 3 illustrates another embodiment 300 of the present invention. Embodiment 300 is similar to presentation display 100 except that embodiment 300 has several additional features. These features include:

- Extra height 322 in center panel 302 to form header 324 above the side trays
- Means 304 for attaching horizontal shelves or trays
- Means 306 for attaching a report pocket
- Means 404 (FIG. 4) for holding the closed embodiment during transport.

The means for attaching shelves, trays or a report pocket will be discussed in more detail below in reference to FIG. 7.

The right tray of embodiment 300 is shown in a partially assembled state.

The means for holding the closed embodiment during transport comprises a backwards 'C' shaped cut about the same size or larger than a typical person's hand. A person carrying the closed embodiment inserts their hand through the 'C' cut and thus can obtain a secure and convenient grip to lift it when it is closed.

The presentation display is closed when it is assembled and the trays are rotated such that they rest against the center panel. The closed display forms a container which can be used to transport contained items, such as reports and display objects related to a science or other school project.

Figure 4:
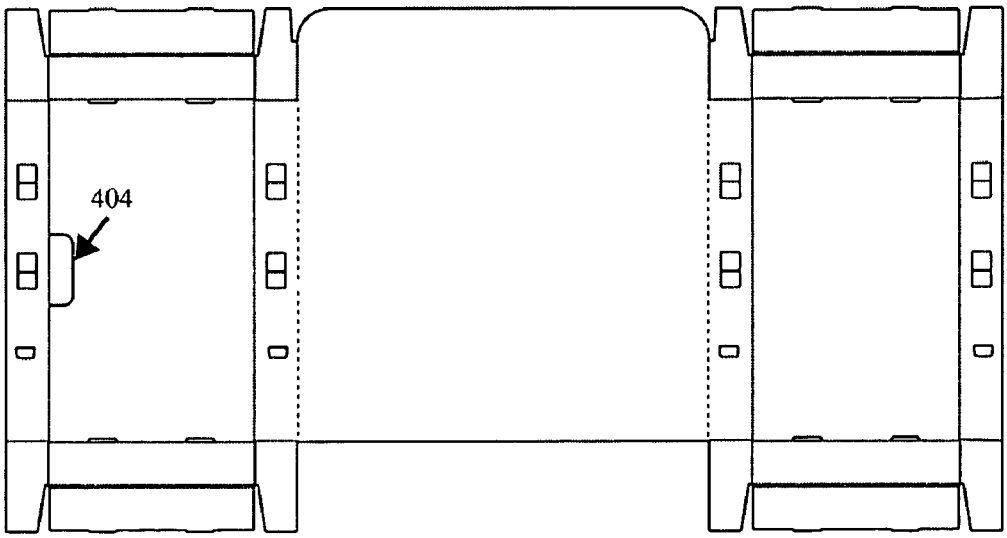
FIG. 4 is a blank for the embodiment of FIG. 3.

FIG. 4 is a blank for embodiment 300.

Figure 5:
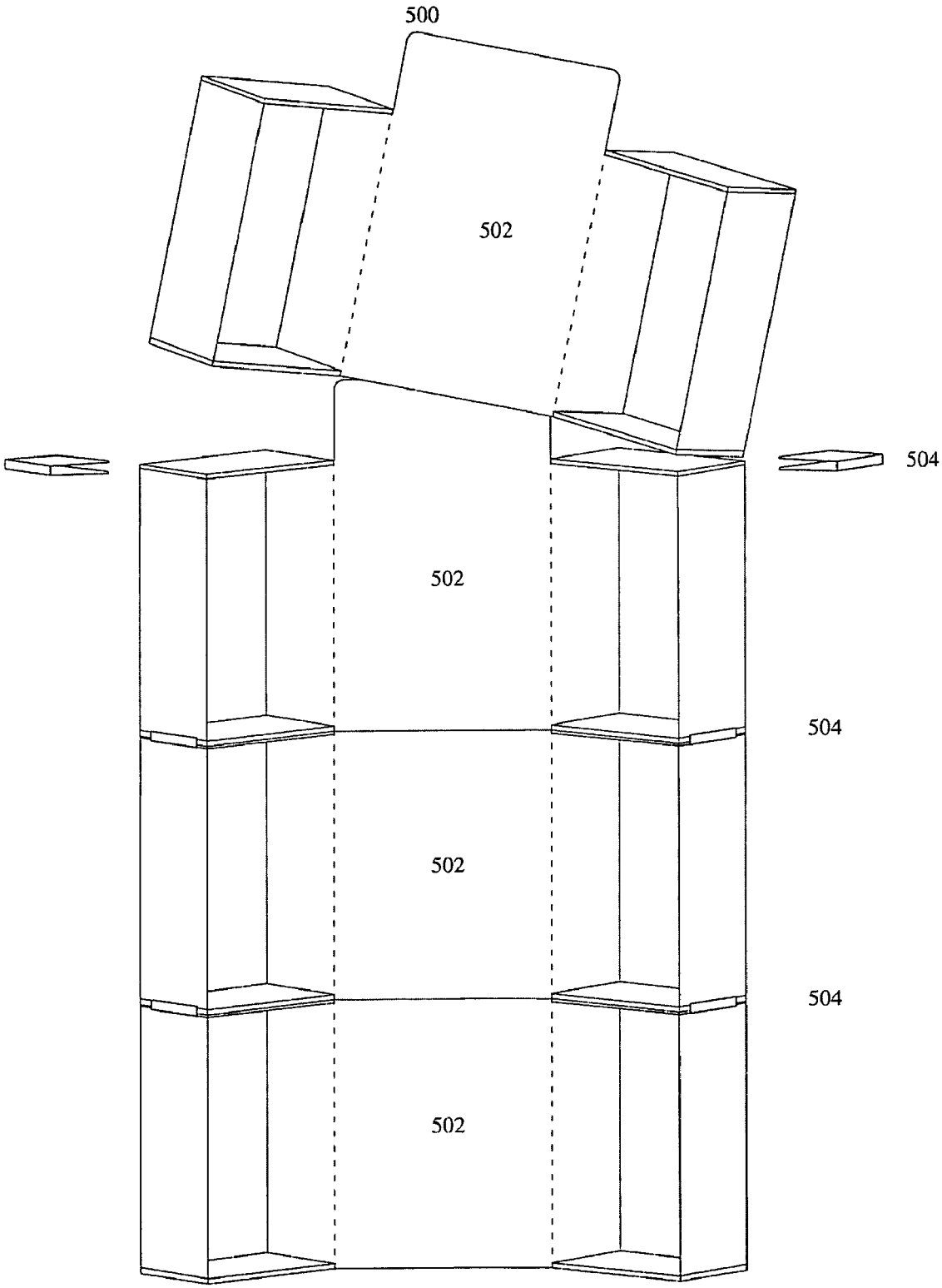
FIG. 5 is a front view of an alternative embodiment of the present invention wherein several presentation displays similar to the embodiment illustrated in FIG. 3 are stacked upon each other.

FIG. 5 shows another embodiment 500 of the present invention. This embodiment comprises several presentation displays 502 stacked upon each other and held in place by stacking tabs 504. Presentation displays 502 are similar to embodiment 300. Stacking tabs are inserted in between the horizontal sidewalls and their respective end tabs of adjacent presentation displays thus securing them together. It should be appreciated that the header 324 of embodiment 300, which feature is also present in this embodiment, contributes to the stability of the combined structure formed by two or more displays 502 in a stacked relationship.

Figure 6:
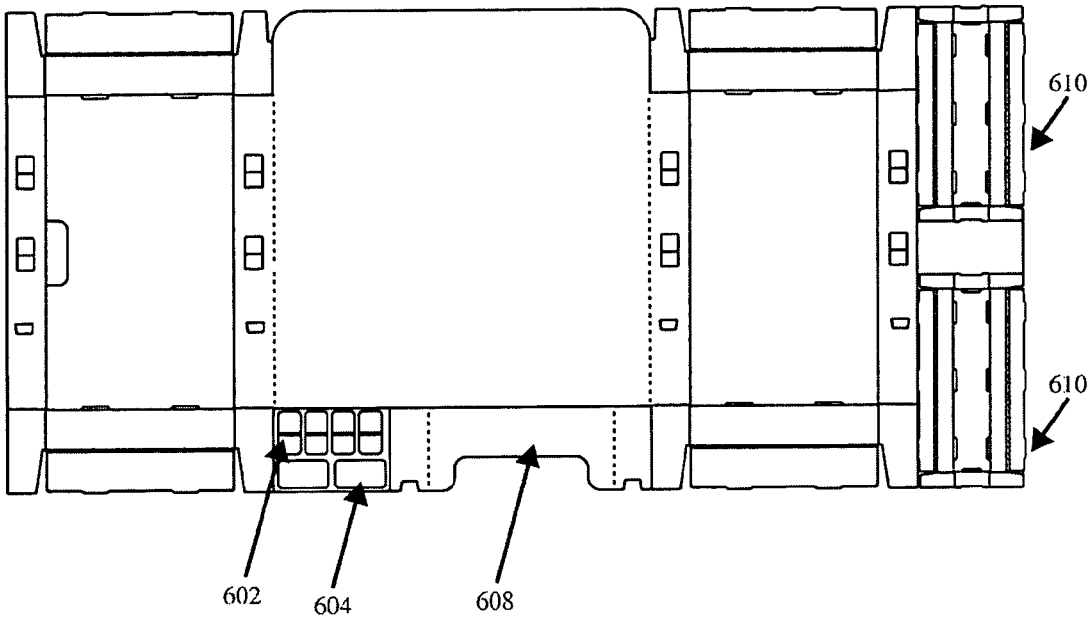
FIG. 6 is an alternative blank for the embodiment of FIG. 3 showing accessories to be added to the embodiment.

FIG. 6 illustrates a blank for combined embodiment 300 and its associated accessories. The accessories include four stacking tabs 602, two closure tabs 604, a report pocket 608 and two shelves 610. The embodiment 300 and associated accessories are laid out to form a generally rectangular blank with minimal waste. The edges of the embodiment and associated accessories are precut, perforated or otherwise treated to allow for easy separation from each other by hand.

Figure 7:
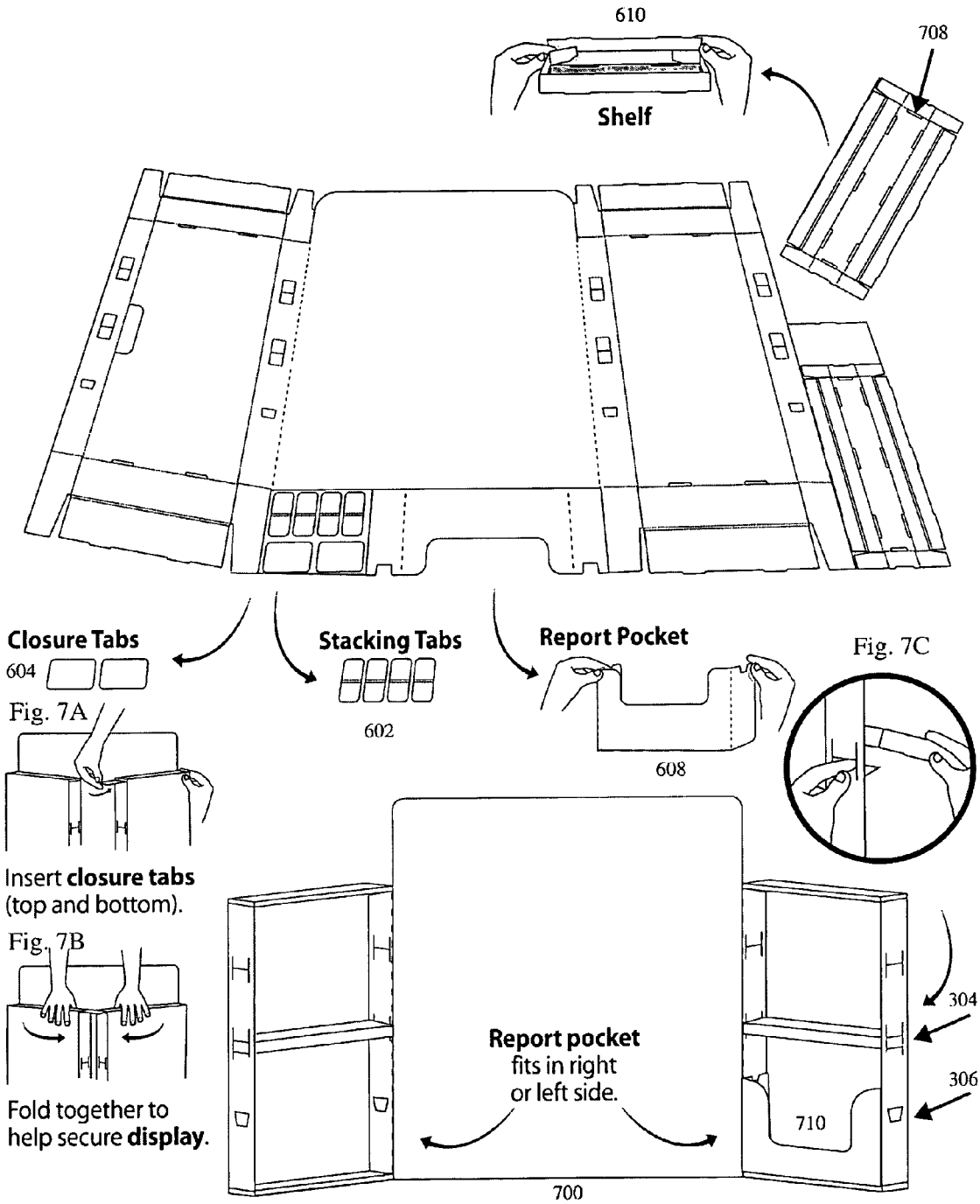
FIG. 7 is a set of assembly drawings for the embodiment of FIG. 3 with accessories.

FIG. 7 is an instructional diagram illustrating how the embodiment and associated accessories are to be separated from each other and assembled into final presentation display 700.

FIG. 7A illustrates how closure tabs are inserted in between the horizontal sidewalls and their respective end tabs to help hold the left tray and right tray together when the presentation display is closed for storage or transport.

FIG. 7B shows the presentation display in a nearly closed position.

The report pocket 608 is attached by means of a 'U' shaped cut in the sidewalls 202 with a horizontal score over the 'U'. This forms a tab which can be pushed open and then folded over the side of the report pocket thus securing it in place. No glue or other attachment means is required. Of course, if desired, glue or other attachment means may be used.

In order to form the shelves, the blanks for the shelves 610 are separated and folded along score lines to produce shelves with a locking tab and locking slot construction similar to that of the side trays.

FIG. 7C illustrates how the assembled shelves are attached to the presentation display. The shelves 304 are attached by means of an 'H' shaped cut in the cardboard with a first horizontal score at the top of the 'H' and a second horizontal score at the bottom of the 'H'. This forms an upper and lower tab which can be pushed open and then folded over the side of the shelf thus securing it in place. No glue or other attachment means is required. Of course, if desired, glue or other attachment means may be used.

Slots 708 may be provided in the shelf to correspond to the upper or lower tab. Either tab may be inserted through a slot thus further securing the shelf in place.

The shelves may be similarly attached in an upside down configuration thus forming trays which in practice have proven to be remarkably strong and secure. Hence they are particularly useful for showing the objects that normally accompany a science fair or school project.

Presentation displays may be sold as folded but unassembled blanks. Blanks are folded along score lines 208 and 209 to form a tri-fold blank. The tri-fold blank may be wrapped in plastic, such as clear plastic. A sheet of paper with printed assembly directions, marketing material, UPC code and other indicia may be inserted beneath the plastic and thus be visible to a person considering purchasing the presentation display.

Various examples of the presentation display of the present invention include the following:

EXAMPLE 1

A presentation display similar to embodiment 700 is constructed from corrugated cardboard. The cardboard is ⅛ inch (0.32 cm) thick, although 1/16 inch cardboard may also be used. The cardboard is white on one side and brown on the other. The white side of the center panel cardboard faces the viewer when the presentation display is assembled and open.

The height of the center panel is 36 inches (91.4 cm) with a 6.5 inch (16.5 cm) header. The width of the center panel is 24 inches (61 cm). The height of the left and right tray is 29.5 inches (75 cm). The width of the left and right tray is 12 inches (30.5 cm). The depth of the left and right tray is 3 inches (7.6 cm). The horizontal sidewalls of the both the left and right trays are formed by a locking tab and locking slot configuration.

Two shelves are provided. Each shelf is 11.75 inches (30 cm) long by 2.75 inches (7.0 cm) wide. The sidewalls of the shelf are 1 inch (2.5 cm) high. The shelf is formed by a locking tab and slot configuration with the locking tabs and slots in the along the long walls of the shelf.

'H' cuts are provided in the vertical sidewalls of the trays to hold the shelves. The shelves have corresponding slots to accept the upper or lower tabs of the 'H' cuts.

A single report holder is provided and held in position by tabs formed by 'C' cuts in the sidewalls of the trays. The report holder is 6.5 inches (16.5 cm) at its maximum height and 3.25 inches (8.26 cm) at its minimum height in the center scoop (710 in FIG. 7). The width of the center scoop is 7.75 inches (19.7 cm).

The hinges connecting the trays to the center panel are formed by ¼ inch (0.64 cm) long cuts through the cardboard. The cuts are spaced ¼ inch (0.64 cm) apart along the score lines.

Two closure tabs are provided. The closure tabs are 2.75 inches (7.0 cm) wide by 4 inches (11 cm) long. The corners of the closure tabs are rounded.

Four stacking tabs are provided. The stacking tabs are 2 inches (5.1 cm) wide by 3.75 inches (9.5 cm) long.

A 'C' cut is provided in the left tray to facilitate holding and carrying the presentation display when it is in the assembled and closed position. The 'C' cut is 3.5 inches (8.9 cm) long by 1.25 inches (3.2 cm) wide.

The blank for the presentation display and accessories are cut into a single sheet of cardboard in a layout similar to FIG. 6. The shapes for the presentation display and accessories are nearly completely cut except for small gaps in the cut to hold the pieces in position during shipment. The pieces are easily removed by hand for assembly. They have clean cut edges.

In order to ship and sell the presentation display, the blank is folded into a tri-fold and wrapped in clear plastic to form a retail package. A sheet of paper with assembly instructions, merchandising indicia and UPC bar code is placed inside the plastic wrapper. The overall dimensions of the retail package is 42.5 inches (108 cm) long by 24 inches (61 cm) wide by 3/16 inches (0.48 cm) thick. The total weight of the retail package is 2.4 lb (1.09 kg)

The dimensions of the retail package correspond to a girth of 90.8 inches (230.6 cm). "Girth", is defined as the longest dimension of a package plus the twice the sum of the remaining two dimensions. Shipping charges are often determined by the girth of a package.

There is often a sharp increase in the price for shipping a package at a critical girth. For shipping by United Parcel Service, Inc. within the continental United States of America as of 2003, for example, packages with a girth of less than 84 inches (213.4 cm) are charged a shipping fee based upon weight. Packages with a girth of more than 84 inches (213.4 cm), however, are charged a minimum fee equivalent to a package weighing 30 lb (13.6 kg). This is irrespective of the actual package weight for packages weighing less than 30 lb (13.6 kg). The 2.4 lb (1.09 kg) retail package in this Example would be charged the same rate as if it weighed 30 lb (13.6 kg).

It is important to minimize shipping costs for presentation displays since the cost of shipping can be comparable to the total cost for manufacturing.

EXAMPLE 2

A presentation display and accessories similar to that described in Example 1 is provided except that the presentation display is black on both sides, instructions and other indicia are printed in white directly onto the back of the center panel of the cardboard, and the overall size is reduced so that the girth is less than 84 inches (213.4).

The height of the center panel is 26 inches (66 cm) with a 6.5 inch (16.5 cm) header. The width of the center panel is 24 inches (61 cm). The height of the left and right tray is 19.75 inches (50.2 cm). The width of the left and right tray is 12 inches (30.5 cm). The depth of the left and right tray is 3 inches (7.6 cm). The horizontal sidewalls of the both the left and right trays are formed by a locking tab and locking slot configuration.

The retail package of the presentation display is 32.5 inches (82.5 cm) long by 24 inches (61 cm) wide by 3/16 inches (0.48 cm) deep. This corresponds to a girth of 81 inches (205.7 cm). The weight including plastic wrap is 2 lb (0.91 kg).

By reducing the girth to less than 84 inches, the shipping cost is cut in half.

EXAMPLE 3

A combined presentation display is formed from a first and second presentation display and accessories stacked upon each other. The first and second presentation displays are the same size and similar to the presentation display of Example 1 but smaller. The size of the retail package for each of the first and second presentation display is 28 inches (71.2 cm) long by 22 inches (55.8 cm) wide by 3/16 inches (48 cm) deep.

The retail package has the same height and width of a standard size poser board sold in stores for use in science fair and school presentations. The retail package can therefore be displayed in the same display means used for poster board.

Another standard size is 20 inches (50.8 cm) wide by 30 inches (76.2) long. The first and second presentation displays can be dimensioned such that their retail packages have the same width and height.

The two presentation displays can be stacked on top of the other and secured using the stacking tabs provided therein. The stacked presentation displays have a total center panel height of 41.5 inches (105.4 cm) with a header above the top presentation display of 5 inches (12.7 cm). The width of the center panels is 22 inches (55.9 cm). The width of the left and right trays is 11 inches (22.9 cm). The combined height of the stacked left and right trays is 36 inches (91.5 cm).

The stacked presentation displays have overall dimensions similar to the presentation display of Example 1. The combined girth of both retail packages, however, is less than 84 inches. Hence the shipping cost of the both retail packages is significantly less than the presentation display of Example 1.

EXAMPLE 4

A presentation display similar to embodiment 700 is constructed from corrugated cardboard. The height of the center panel is 10 inches (25.4 cm) with a 2 inch (5.08 cm) header. The width of the center panel is 12 inches (30.5 cm). The height of the left and right tray is 8 inches (20.3 cm). The width of the left and right tray is 6 inches (15.2 cm). The depth of the left and right tray is 1 inch (2.5 cm). The horizontal sidewalls of the both the left and right trays are formed by a locking tab and locking slot configuration.

EXAMPLE 5

A presentation display similar to embodiment 700 is constructed from corrugated cardboard. The height of the center panel is 72 inches (183 cm) with a 12 inch (30.5 cm) header. The width of the center panel is 48 inches (123 cm). The height of the left and right tray is 60 inches (153 cm). The width of the left and right tray is 24 inches (61 cm). The depth of the left and right tray is 6 inches (15.2 cm). The trays are formed by gluing the sidewalls together.

Having thus described the invention with particular reference to the embodiments thereof, it will be obvious that various changes and modifications can be made therein without departing from the spirit and scope of the present invention as defined in the appended claims.

Wherefore I claim:

1. A presentation display comprising:

a center panel;

a left tray; and a right tray, wherein the left tray is attached to the center panel with a first flexible hinge and the right tray is attached to the center panel with a second flexible hinge, and wherein said center panel, said left tray and said right tray are formed from a single piece of material, and further wherein said left tray and said right tray are defined by a substantially flat floor panel and four walls, including a top wall, bottom wall and two side walls, said walls and panel defining a cavity having an opening providing access thereto, and further wherein either the left tray or the right tray includes an 'H' cut in the material of the tray; and a three-dimensional shelf including a slot for receiving and retaining said 'H' cut, and wherein, each of any said shelf positioned in said left tray is separate and independent of any said shelf positioned in said right tray.

2. The presentation display of claim 1 wherein said single piece of material is corrugated cardboard.

3. The presentation display of claim 1 wherein the center panel comprises a header.

4. The presentation display of claim 1 wherein either the left tray or the right tray includes a locking tab and a locking slot.

5. The presentation display of claim 1 wherein disposed within either the left tray or the right tray is a support structure selected from the group consisting of shelves, trays and pockets.

6. The presentation display of claim 1 wherein the dimensions of the left tray and the right tray are approximately equal, and further wherein the combined width of the left tray and right tray is about equal to or less than the width of the center panel.

7. The presentation display of claim 6 wherein the height of the center panel is in the range of 10 inches to 72 inches; the width of the center panel is in the range of 12 inches to 48 inches; the height of the left and right tray is in the range of 8 to 60 inches; the width of the left and right tray is in the range of 6 inches to 24 inches and the depth of the left tray and the right tray is in the range of 1 inch to 6 inches.

8. The presentation display of claim 1 wherein either the left tray or the right tray is assembled using an adhesive.

9. The presentation display of claim 1 wherein the presentation display includes a plurality of tabs and corresponding slots which may be folded so as to assemble the display without the use of glue, tape, adhesive or fasteners.

10. The presentation display of claim 1 wherein the left tray and the right tray are provided initially in an unassembled state having a substantially flat profile for shipping.

11. The presentation display of claim 1 wherein the sum of the longest dimension plus twice the shortest dimension of the display in the unassembled state is less than 84 inches.

12. The presentation display of claim 11 wherein the height of the presentation display is in the range of 28 to 30 inches and the width of the presentation display is in the range of 20 to 22 inches.

13. A presentation display comprising:

a single flexible sheet of material foldable into an assembled configuration to create:

a center panel;

a left tray attached to the center panel with a first flexible hinge; and a right tray attached to the center panel with a second flexible hinge, wherein the left tray and the right tray each include:

a substantially flat center panel including a locking slot therein, a first pair of opposing side walls each having a pair of end tabs, and a second pair of opposing side walls each having a fold and a locking tab, wherein, in the assembled configuration, each tray includes the fold of each of the second pair of opposing side walls enclosing one of the pair of end tabs of each of the first pair of opposing side walls, and the locking tab engages the locking slot to maintain the assembled configuration such that the trays each define a cavity having an opening providing access thereto.

* * * * *